United States Patent [19]

Beckley et al.

[11] Patent Number: 4,904,312

[45] Date of Patent: Feb. 27, 1990

[54] METHOD OF ELECTROLYTICALLY ETCHING LINEAR IMPRESSIONS IN ELECTRICAL STEEL

[75] Inventors: Philip Beckley, Newport; David Snell, Abertillery, both of United Kingdom

[73] Assignee: British Steel plc, London, England

[21] Appl. No.: 230,429

[22] Filed: Aug. 10, 1988

[30] Foreign Application Priority Data

Aug. 22, 1987 [GB] United Kingdom ..... 8719872

[51] Int. Cl.[4] ..... H01F 1/04

[52] U.S. Cl. ..... 148/110; 148/111; 148/307; 148/308; 156/664; 204/129.1; 204/129.35; 204/129.95

[58] Field of Search ..... 148/110, 111, 307, 308; 156/664; 204/129.1, 129.35, 129.5

[56] References Cited

U.S. PATENT DOCUMENTS

| | | | |
|---|---|---|---|
| 2,590,927 | 4/1952 | Brandt et al. | 204/129.95 |
| 3,054,737 | 9/1962 | Salt | 204/129.95 |
| 4,178,194 | 12/1979 | Azzerri et al. | 148/113 |
| 4,750,949 | 6/1988 | Kobayashi et al. | 148/111 |

OTHER PUBLICATIONS

"On the Mechanism of Domain Refinement Due to Scratching", H. Pfutzner et al., *Japanese Journal of Applied Physics,* vol. 21, No. 9, Sep. 1982, pp. L580–L582.

"Laser Processing for Reducing Core Loss of Grain Oriented Silicon Steel", T. Iuschi et al., *Journal of Applied Physics,* vol. 53, No. 3, Mar. 1982, pp. 2410–2412.

"Domain Control by Spark Ablation", P. Beckley et al., *Journal of Applied Physics,* vol. 57, No. 1, Apr. 1985, pp. 4212, 4213.

*Primary Examiner*—Melvyn J. Andrews

*Attorney, Agent, or Firm*—Bacon & Thomas

[57] ABSTRACT

This invention relates to a method of enhancing linear impressions formed in the surface of grain oriented electrical steel strip, by electrolytically etching said impressions with e.g. citric acid. The impressions may be formed by mechanical wheel scribing or by surface ablation, e.g. by spark discharge or laser treatment, and may be continuous or discontinuous in the form of spots or lines. In accordance with this invention therefore, the initial generation of light impressions in steel strip formed by mechanical wheel scribing or spark ablation techniques can readily be enhanced by application of the electrolytic etching technique to produce a material exhibiting values of power loss (reduced from the original unscribed loss value) which are substantially anneal-proof. In comparison, conventionally scribed material shows no resistance to a high temperature anneal as far as loss reduction is concerned.

11 Claims, No Drawings

METHOD OF ELECTROLYTICALLY ETCHING LINEAR IMPRESSIONS IN ELECTRICAL STEEL

This invention relates to high permeability grain-oriented 'electrical' steel, that is steel strip used for electromagnetic applications e.g. to form a magnetic circuit in electrical machines. Processing such steel in a known manner promotes the growth of large grains within the steel, and preferential orientation of same leading to enhanced magnetic characteristics.

A problem associated with the production of such grain oriented steel is that production of optimum grain alignment tends to lead at the same time to grains of larger than optimum size which is detrimental in the sense that the magnetic domain wall spacing within the grain becomes so large that, in use, rapid movement of the domain walls (caused by the greater distance to be moved by these walls in unit time) create severe micro-eddy currents which in turn cause severe power loss.

It is known to overcome this problem by providing artificial barriers which simulate the effect of grain boundaries in the strip, reducing the domain spacing and thus reducing the movement of the domain walls. Typically such barriers are produced by scribing lines or spots across the surface of the strip by mechanical or electrical-discharge means, e.g. as described in our UK Pat. No. 2146567.

For wound core applications it is often advantageous to relieve stresses arising in the steel slit from the coil by annealing at a high temperature, c.800° C. This treatment however results in the loss or mitigation of the domain-refining effect of the artificial barriers produced by conventional scribing methods.

Attempts to overcome this drawback have been made by chemically etching with nitric acid at least such material which has had barriers created by laser-produced spots.

It is an object of this invention to effect an anneal-proof domain control without the use of hostile acids.

From one aspect the present invention provides a method of enhancing linear impressions formed in the surface of grain oriented electrical steel strip, by electrolytically etching said impressions.

The impressions may be formed by mechanical wheel scribing or by surface ablation, e.g. by spark discharge or laser treatment, and may be continuous or discontinuous in the form of spots or lines. The depth of the impressions may typically be 3μ. The etching may be effected using a mild citric acid based electrolyte.

The use of citric acid is advantageous in the sense that it is not harmful or aggressive and can readily be discharged through normal effluent channels.

In accordance with this invention therefore, the initial generation of light impressions in steel strip formed by mechanical wheel scribing or spark ablation techniques can readily be enhanced by application of the electrolytic etching technique to produce a material exhibiting values of power less (reduced from the original unscribed loss value) which are substantially anneal-proof. In comparison, conventionally scribed material shows no resistance to a high temperature anneal as far as loss reduction is concerned.

In order that the invention may be fully understood, some embodiments thereof will now be described with reference to a variety of sample treatments.

A first group of phosphate coated Epstein samples of 3% silicon grain oriented steel of know permeability (high) and power loss was lightly scribed with a mechanical wheel system with 5 mm line spacing whilst another group was spark ablated; each group was divided with one set subjected to a chemical etch in nitric acid and another subjected to an electrolytic etch in a mild citric acid based electrolyte.

In particular, the composition of this electrolyte was:

Trisodium citrate: 98 gms/liter,

Citric acid: 35 gms/liter,

Sodium chloride: 10 gms/liter.

The pH value was of the order of 4.7.

Power loss (at B=1.7, 50 HZ) and permeability ($B_{1kA/m}$) values for the samples were determined. The samples were then re-coated to cover the fissures and maintain the integrity of the insulation, the coating was cured and the sample then annealed at 800° C. The power loss and permeability values were the measured again.

More particularly, 'summary' results are set out in the following tables in which:

Table 1 refers to power loss measurements on wheel scribed samples etched with nitric acid Table 2 refers to power loss measurements on spark ablated samples etched with nitric acid Table 3 refers to permeability measurements on the samples identified, and as treated, in Tables 1 and 2 (data relating to loss reduction retained is also shown for comparison)

Table 4 refers to power loss measurements on wheel scribed samples electrolytically etched in a sodium citrate/citric acid solution-pH value 4.7

Table 5 refers to power loss measurements on electrolytically etched spark ablated samples; and Table 6 refers to permeability measurements on the samples identified, and as treated, in Tables 4 and 5.

In the above examples, the depth of the initial groove or pit (on material spark ablated) was approximately 3μ.

WHEEL SCRIBED

TABLE 1

| Nitric Acid 20% v/v Treatment | | Grove | % Loss Reduction | | |
|---|---|---|---|---|---|
| Temp (°C.) | Time (Secs) | Depth (μ) | Initial | After Anneal | Reduction Retained |
| | 30 | 6 | 7.7 | 5.7 | 74 |
| | 60 | 6 | 5.8 | 2.9 | 50 |
| 18.5 | 120 | 10 | 5.4 | 5.9 | 109.3 |
| | 180 | 16 | 6.7 | 6.1 | 91.0 |
| | 10 | 7 | 6.7 | 4.9 | 73.1 |
| 32 | 30 | 9 | 8.3 | 7.1 | 85.5 |
| | 60 | 12 | 5.0 | 4.7 | 94 |
| | 10 | 8 | 4.8 | 3.8 | 79 |
| | 20 | 10 | 5.7 | 3.7 | 65 |
| 44 | 40 | 12 | 4.0 | 3.9 | 97.5 |
| | 60 | 18 | 7.8 | 7.2 | 92.3 |
| | 90 | 27 | 5.6 | 5.3 | 94.6 |

SPARK ABLATED

TABLE 2

| Nitric Acid Treatment 20% v/v | | Pit | % Loss Reduction (Mean of 5 Samples) | | % Loss |
|---|---|---|---|---|---|
| Temp (°C.) | Time (Secs) | Depth (μ) | Initial | After Anneal | Reduction Retained |
| 40 | 20 | 7 | 8.4 | 4.1 | 48.8 |
| 40 | 45 | 10 | 7.2 | 2.8 | 38.8 |
| 40 | 60 | 14 | 7.2 | 4.3 | 59.7 |
| 40 | 90 | 18 | 7.6 | 5.3 | 69.7 |
| 52 | 45 | 23 | 8.3 | 3.0 | 32 |
| 52 | 60 | 29 | 8.6 | 5.3 | 61.5 |

TABLE 2-continued

| Nitric Acid Treatment 20% v/v | | Pit | % Loss Reduction (Mean of 5 Samples) | | % Loss |
|---|---|---|---|---|---|
| Temp (°C.) | Time (Secs) | Depth (μ) | Initial | After Anneal | Reduction Retained |
| 52 | 75 | 30 | 9.0 | 5.2 | 58 |
| 52 | 90 | 31.6 | 8.5 | 5.5 | 62.6 |
| 52 | 120 | 35.6 | 9.2 | 8.0 | 87.1 |

TABLE 4-continued

| Electrolytic Treatment pH 4.7 | | Groove | % Loss Reduction (Mean of 5 Samples) | | % Loss |
|---|---|---|---|---|---|
| Current (Amps) | Time (Secs) | Depth (μ) | Initial | After Anneal | Reduction Retained |
| | 60 | 21 | 5.2 | 4.2 | 80.8 |
| | 5 | 6 | 6.0 | 1.7 | 28.3 |
| 43 | 10 | 10 | 5.6 | 5.5 | 97.9 |
| | 15 | 16 | 4.3 | 5.5 | 127.3 |

TABLE 3

| Nitric Acid Treatment | | $B_{1KA/m}(T)$ | | | | Groove or % Loss | |
|---|---|---|---|---|---|---|---|
| Temp (°C.) | Time (Secs) | Initial | Final | Change (−VE) | % Change Initial/ Final (−VE) | Pit Depth (μ) | Reduction Retained |
| | | | | Wheel Scribing | | | |
| 18.5 | 30 | 1.965 | 1.962 | 0.003 | 0.2 | 6 | 74 |
| | 60 | 1.954 | 1.954 | 0 | 0 | 6 | 50 |
| | 120 | 1.954 | 1.949 | 0.005 | 0.3 | 10 | 109.3 |
| | 180 | 1.956 | 1.920 | 0.036 | 1.8 | 16 | 91.0 |
| 32 | 10 | 1.959 | 1.956 | 0.003 | 0.2 | 7 | 73.1 |
| | 30 | 1.961 | 1.961 | 0 | 0 | 9 | 85.5 |
| | 60 | 1.954 | 1.939 | 0.015 | 0.8 | 12 | 94 |
| 44 | 10 | 1.948 | 1.938 | 0.010 | 0.5 | 8 | 79 |
| | 20 | 1.958 | 1.952 | 0.006 | 0.3 | 10 | 65 |
| | 40 | 1.953 | 1.941 | 0.012 | 0.6 | 12 | 97.5 |
| | 60 | 1.960 | 1.935 | 0.025 | 1.3 | 18 | 92.3 |
| | 90 | 1.949 | 1.899 | 0.050 | 2.6 | 27 | 94.6 |
| | | | | Spark Ablation | | | |
| 40 | 20 | 1.959 | 1.958 | 0.001 | 0.1 | 7 | 48.8 |
| | 45 | 1.955 | 1.955 | 0 | 0 | 10 | 38.8 |
| | 60 | 1.962 | 1.946 | 0.016 | 0.8 | 14 | 59.7 |
| | 90 | 1.959 | 1.939 | 0.020 | 1.0 | 18 | 69.7 |

WHEEL SCRIBED

TABLE 4

| Electrolytic Treatment pH 4.7 | | Groove | % Loss Reduction (Mean of 5 Samples) | | % Loss |
|---|---|---|---|---|---|
| Current (Amps) | Time (Secs) | Depth (μ) | Initial | After Anneal | Reduction Retained |
| 10 | 10 | 7 | 5.2 | 0.3 | 5.8 |
| | 30 | 12 | 6.5 | 4.0 | 61.5 |
| | 60 | 19 | 5.9 | 6.1 | 103.4 |
| | 5 | 6 | 5.3 | 2.0 | 37.8 |
| | 10 | 8 | 5.6 | 2.0 | 35.7 |
| 20 | 20 | 11 | 4.2 | 1.8 | 42.9 |
| | 30 | 13 | 2.3 | 3.2 | 139.1 |
| | 40 | 13 | 5.5 | 7.5 | 136.3 |

SPARK ABLATED

TABLE 5

| Electrolytic Treatment pH 4.7 | | Pit | % Loss Reduction (Mean of 5 Samples) | | % Loss |
|---|---|---|---|---|---|
| Current (Amps) | Time (Secs) | Depth (μ) | Initial | After Anneal | Reduction Retained |
| 20 | 5 | 6 | 7.4 | 1.7 | 22.9 |
| 20 | 15 | 11 | 8.9 | 3.5 | 39.3 |
| 20 | 30 | 13 | 8.5 | 5.2 | 61.2 |
| 20 | 60 | 16 | 6.5 | 4.4 | 67.6 |
| 43 | 40 | 34 | 8.2 | 6.8 | 82.9 |
| 43 | 60 | 37.8 | 7.9 | 3.6 | 45.6 |
| 43 | 75 | 46 | 8.5 | 2.6 | 30.6 |

TABLE 6

| Electrolytic Treatment | | $B_{1KA/m}(T)$ | | | | Groove or | % Loss |
|---|---|---|---|---|---|---|---|
| Temp (°C.) | Time (Secs) | Initial | Final | Change (−VE) | % Change Initial/ Final (−VE) | Pit Depth (μ) | Reduction Retained |
| | | | | Wheel Scribing | | | |
| 10 | 10 | 1.960 | 1.955 | 0.005 | 0.26 | 7 | 5.8 |
| | 30 | 1.958 | 1.949 | 0.009 | 0.46 | 12 | 61.5 |
| | 60 | 1.958 | 1.934 | 0.024 | 1.23 | 19 | 103.4 |
| 20 | 5 | 1.959 | 1.958 | 0.001 | 0.2 | 6 | 37.8 |
| | 10 | 1.955 | 1.948 | 0.007 | 0.36 | 8 | 35.7 |
| | 20 | 1.959 | 1.947 | 0.012 | 0.61 | 11 | 42.9 |
| | 30 | 1.953 | 1.937 | 0.016 | 0.82 | 13 | 139.1 |
| | 40 | 1.957 | 1.939 | 0.018 | 0.92 | 13 | 136.3 |
| | 60 | 1.956 | 1.900 | 0.056 | 2.86 | 21 | 80.8 |
| 43 | 5 | 1.963 | 1.962 | 0.001 | 0.05 | 6 | 28.3 |
| | 10 | 1.953 | 1.940 | 0.013 | 0.67 | 10 | 97.9 |
| | 15 | 1.957 | 1.934 | 0.023 | 1.18 | 16 | 127.3 |
| | | | | Spark Ablation | | | |
| 20 | 5 | 1.958 | 1.956 | 0.002 | 0.10 | 6 | 22.9 |
| | 15 | 1.954 | 1.952 | 0.002 | 0.10 | 11 | 39.3 |
| | 30 | 1.961 | 1.954 | 0.007 | 0.36 | 13 | 61.2 |

TABLE 6-continued

| Electrolytic Treatment | | $B_{1KA/m}$(T) | | | | | |
|---|---|---|---|---|---|---|---|
| Temp (°C.) | Time (Secs) | Initial | Final | Change (−VE) | % Change Initial/ Final (−VE) | Groove or Pit Depth (μ) | % Loss Reduction Retained |
| | 60 | 1.956 | 1.940 | 0.016 | 0.82 | 16 | 67.6 |

An analysis of Tables 1 and 2 show that chemical etching of both wheel scribed and spark ablated samples in nitric acid is suitable for producing groove and pit depths sufficient for power loss reduction values to be achieved which are resistant to annealing at 800° C. This is more readily attainable with wheel scribed lines than spark ablated samples but the results obtained with the latter (Table 2) have not been totally optimised.

These permeability values are reproduced in Table 3, from which table it can be seen that although in general the higher the retention of power loss reduction (and the deeper the groove), the larger the decrease in permeability values, the maximum decrease in permeability of the samples chosen, 2.6%, would not result in the steel going out of specification i.e. $B_{1kA/m} < 1.89T$.

Referring to Tables 4 and 5 comparable data is tabulated in respect of electrolytically etched samples and it will be seen that values of power loss retention on anneal retained for wheel scribed material are superior to those obtained with nitric acid etching, the results for spark ablated material being very similar.

As regards permeability changes a comparison between Tables 3 and 6 shows that in general reduction in permeability values for electrolytically treated material are similar to those obtained for nitric acid etched material. Again, none of the examples given caused the material to go out of specification for the parameter.

In essence therefore, although it is clear that optimum groove and pit depths have yet to be determined precisely and a satisfactory compromise reached between degradation of $B_{1kA/m}$ values and resistance to anneal, an electrolytic etch utilising a citric acid based electrolyte is in many cases superior to a nitric acid etch and, as mentioned, this carries with it the advantages attendant on the use of a non-hostile acid. Whereas as described, such an electrolytic etch can be applied to mechanically scribed or spark ablated material, mechanically scribed material is more readily etched.

Although this invention has been described with reference to a particular set of results, it is to be understood that these are exemplary only, and various modifications may readily be made to the factors recited, electrolyte composition, treatment times and temperatures etc. without departing from the scope of this invention.

We claim:

1. A method of enhancing linear impressions formed in the surface of grain oriented electrical steel strip comprising electrolytically etching said impressions in an electrolyte comprising a mild acid.

2. A method according to claim 1, in which the impressions are formed by wheel scribing.

3. A method according to claim 1, in which the impressions are formed by spark discharge.

4. A method according to claim 1, in which the impressions are formed by laser treatment.

5. A method according to claim 3, in which the impressions are continuous in the form of spots or lines.

6. A method according to claim 3, in which the impressions are discontinuous and are in the form of spots or lines.

7. A method according to claim 3, in which the impressions are of the order of 3μ deep.

8. A method according to claim 1, in which the electrolyte comprises citric acid.

9. A method of enhancing continuous linear impressions scribed into the surface of grain oriented electrical steel strip comprising electrolytically etching said impressions in an electrolyte comprising citric acid.

10. A method according to claim 9, in which the impressions are of the order of 3μ deep.

11. Steel strip which has been subjected to the method according to claim 1 or 9.

* * * * *